US008651067B2

(12) United States Patent
Juretzek

(10) Patent No.: US 8,651,067 B2
(45) Date of Patent: Feb. 18, 2014

(54) STEAM CIRCUIT IN A POWER STATION

(75) Inventor: Uwe Juretzek, Finspång (SE)

(73) Assignee: Siemens Aktiengesellschaft, München (DE)

( * ) Notice: Subject to any disclaimer, the term of this patent is extended or adjusted under 35 U.S.C. 154(b) by 1470 days.

(21) Appl. No.: 12/087,383

(22) PCT Filed: Jan. 4, 2007

(86) PCT No.: PCT/EP2007/050081

§ 371 (c)(1),
(2), (4) Date: Nov. 18, 2008

(87) PCT Pub. No.: WO2007/077248

PCT Pub. Date: Jul. 12, 2007

(65) Prior Publication Data

US 2009/0165460 A1 Jul. 2, 2009

(30) Foreign Application Priority Data

Jan. 5, 2006 (EP) ..... 06000183

(51) Int. Cl.
*F22D 7/00* (2006.01)

(52) U.S. Cl.
USPC ..... 122/406.1; 122/414; 122/415

(58) Field of Classification Search
USPC ..... 122/406.1, 406.2, 406.3, 408.1, 411, 122/414, 415
See application file for complete search history.

(56) References Cited

U.S. PATENT DOCUMENTS

| | | | | |
|---|---|---|---|---|
| 2,321,390 | A * | 6/1943 | Juzi | 122/1 B |
| 3,478,726 | A * | 11/1969 | Kikinis | 122/406.1 |
| 4,031,404 | A * | 6/1977 | Martz et al. | 290/40 R |
| 4,241,701 | A * | 12/1980 | Morse | 122/460 |
| 4,408,460 | A * | 10/1983 | Paquet | 60/678 |
| 5,333,677 | A * | 8/1994 | Molivadas | 165/272 |
| 6,237,542 | B1 * | 5/2001 | Nakajo et al. | 122/7 R |
| 6,237,543 | B1 * | 5/2001 | Charoton et al. | 122/7 R |
| 6,301,895 | B1 * | 10/2001 | Kallina et al. | 60/653 |
| 6,920,760 | B2 * | 7/2005 | Schottler et al. | 60/772 |
| 2004/0011019 | A1 * | 1/2004 | Schottler et al. | 60/39.182 |
| 2005/0034445 | A1 * | 2/2005 | Radovich | 60/39.182 |
| 2009/0178403 | A1 * | 7/2009 | Juretzek | 60/530 |

FOREIGN PATENT DOCUMENTS

| | | |
|---|---|---|
| FR | 2 526 523 | 11/1983 |
| GB | 788704 | 1/1958 |

OTHER PUBLICATIONS

Michael Pearson; Robert W. Anderson; "Questions about condensate quenching, prestart purging"; Power; Jul. 2000; pp. 41-42, 44; vol. 144, No. 4; XP000954502; McGraw-Hill Company, New York, NY, US.

* cited by examiner

*Primary Examiner* — Gregory A Wilson

(57) ABSTRACT

The invention relates to a steam circuit in a power station, comprising at least one evaporator and at least one superheater, characterized in that a condensate collector and return line is provided between the superheater and the steam generator to trap condensate in the superheater and return the condensate to the evaporator.

20 Claims, 2 Drawing Sheets

STEAM CIRCUIT IN A POWER STATION

CROSS REFERENCE TO RELATED APPLICATIONS

This application is the US National Stage of International Application No. PCT/EP2007/050081, filed Jan. 4, 2007 and claims the benefit thereof. The International Application claims the benefits of European application No. 06000183.1 filed Jan. 5, 2006, both of the applications are incorporated by reference herein in their entirety.

FIELD OF INVENTION

The invention relates to a steam circuit in a power station comprising at least one steam generator and at least one overheater.

BACKGROUND OF THE INVENTION

Steam circuits of this type are known from steam power stations and combined gas and steam power stations, where the thermal energy from steam is converted into kinetic energy in a steam turbine. The steam required to drive the steam turbine is generated in a steam generator from previously purified and desalinated water and overheated in an overheater. The steam is fed from the overheater to the steam turbine, where it releases part of its previously collected thermal energy to the turbine in the form of kinetic energy. A generator is connected to the turbine, which generator transforms the movement of the turbine into electric energy. After flowing through the steam turbine, the decompressed and cooled steam is directed into a condenser, where it cools further by emitting heat and collects in liquid form as water in the so-called hot well. From there the water is pumped via appropriate pumps into a feed water tank and held in reserve there. Finally the condensate is returned to the steam generator via a feed pump. The steam generator itself can be heated using conventional fuels, such as, for example, oil, gas or coal, but can also be heated using nuclear power.

During the operation of the steam circuit, impurities enter into the water used in the circuit, and with time these impurities can result in damage to the steam circuit components. Accordingly, it is necessary to ensure that the chemical, the chemical composition of the circuit medium (water, steam) remains within certain limits. In the case of boilers with cylindrical boiler shells (natural or forced circulation), this is achieved, for example, by water from the drum being blown down constantly or at intervals. In addition, during the starting up and shutting down procedures, water accumulates at the overheater heating surfaces. This water is removed as waste water and must be replaced by treated water (demineralized water). For economical reasons, it is desirable to reduce the proportion of waste water produced and to increase the proportion of reused process waste water. However this is offset by the very high costs involved in the building of the power station, so that with respect to the economic efficiency of the power station as a whole, with the previously known technical options minimizing the waste water arising was not as a rule a good idea. Therefore, in most cases, the steam circuit process waste water produced is just collected and subsequently all thrown away, thus ultimately routed into a waste water system. In most cases, the waste water must undergo a predetermined treatment in accordance with statutory regulations.

In the future, due to a foreseeable further tightening of the terms of environmental protection one can assume that a reduction in the amount of waste water will be enforced by law or that the output of waste water, including conditioning will be made so expensive that a reduction of the amount of waste water will make good economic sense.

In a steam circuit the waste water produced is generally divided into two groups. Draining in the steam area of the steam circuit, such as, for example, draining of the overheater, delivers "clean" waste water, i.e., the chemical composition of the waste water allows it to be reused straight away in the steam circuit. Draining in the water area of the steam circuit, such as, for example, the emergency blow down on the cylindrical boiler shell, produces, in contrast "contaminated" waste water, which means that the chemical composition of the waste water does not permit it to be reused straight away in the steam circuit. The purity of the waste water from the draining in the steam area is based on the fact that during the separation in the steam generator in water and steam phase any impurities in the water phase remain and the steam that leaves the steam generator is clean.

If one is able to collect the clean waste water separately, so that it becomes possible to feed it back into the steam circuit again, then in addition to a reduction of up to 60% in the amount of waste water produced and the expenses related to that, one also saves the corresponding expenses related to the generation and subsequent conditioning of demineralized water that had to replace the discarded water in the circuit.

The greatest proportion of clean waste water occurs at the overheater when starting up and especially when shutting down the power station. This fact makes use of a known concept for minimizing waste water in a steam circuit, wherein the overheater drain lines lead to a separate collector tank. Using a pump the condensate is then pumped from the collector tank into a condensate collector tank and from then on to the condenser of the steam circuit. The known concept is described in more detail below with reference to FIG. 1.

SUMMARY OF INVENTION

It is an object of the present invention to create an alternative steam circuit in a power station.

According to the present invention, the object is achieved using a steam circuit according to the claims. The dependent claims relate to individual embodiments of the steam circuit according to the invention.

The steam circuit according to the present invention comprises at least one steam generator and at least one overheater. According to the invention a condensate collector and return line including small-capacity pumps is provided between the overheater and the steam generator to trap condensate in the overheater and return the condensate to the evaporator. The corresponding drain lines from the steam area, which are situated in front of the boiler slide valve are connected into this condensate collector and return line. This condensate collector and return line is constantly under pressure, as at least one, advantageously all drain lines are directly connected to it, i.e. motorized flow control devices are not used. In contrast to prior art, the condensate that may gather in the overheater is thus not pumped to the condenser via a collector tank and a condensate collector tank and from there returned to the actual steam circuit of the power station, but the condensate is just collected in a condensate collector and return line and returned directly to the evaporator. In addition to the motorized flow control devices one also does not have to have the collector tank(s) including associated secondary components, such as, for example, pumps, heat exchangers, connecting pipe work etc. Preferably a surge tank is provided between the drain line and the condensate collector and return line, in order to minimize any transverse flows. Further, the diameter of an overheater pipe should be greater than the diameter of the drain line. If applicable it is also possible for several drain lines with a smaller diameter to lead to the condensate collector and return line. This serves to minimize those transverse flows that could occur despite the surge tank. In order to control any transverse flows that may arise due to different pressure at the individual drainage points, in addition the drain lines installed where the pressure is lower should be designed with a greater diameter than the drain lines installed where the pressure is higher. It would also be possible to route each of the individual drain lines—apart from one drain line, via which a constant open connection is ensured so that the condensate collector and return line is always under pressure—via a motorized valve in the condensate collector and return line, instead of directly to the condensate collector line. However, this alternative would be more cost intensive.

One pump is advantageously functionally-connected to the condensate collector and return line, and with the help of said pump the condensate collected in the condensate collector and return line of the overheater can be pumped back into the steam generator. Preferably the operation of the pump can be regulated by the amount of condensate present in the condensate collector and return line. For example if a 2-point level detection device is provided, which detects an upper and a lower condensate level limit in the condensate collector line. When the upper level is reached the pump is operated to pump the condensate out of the condensate collector and return line into the evaporator. If the lower level is reached then accordingly the pump is switched off so as not to pump any more condensate into the steam generator. If the condensate reaches the upper limit level of the condensate collector line without the pump operation starting, then this is an indication that the pump and/or the control is faulty. For such an event the condensate collector line preferably includes an outlet line provided with an emergency valve, which outlet line branches off from the condensate collector and return line, wherein the outlet line is connected to a waste water tank. In this way, the condensate collector and return line can be emptied provisionally in the event of the pump or pump control system failing.

According to a further embodiment of the present invention, the condensate collector and return line comprise at least one flow control device, even better two flow control devices, which are provided one upstream and one downstream of the pump. Accordingly maintenance and repair work can be undertaken on the pump while the steam circuit is operating.

According to a further embodiment of the present invention at least one drain line is arranged between the overheater and the condensate collector line, which drain line connects the overheater with the condensate collector line. Preferably a surge tank is provided between the drain line and the condensate collector line, in order to minimize any transverse flows that may occur. Further the diameter of an overheater pipe from which the drain line branches off should be greater than the diameter of the drain line. If applicable it is also possible for several drain lines with a smaller diameter to lead to the condensate collector line. This serves to minimize those transverse flows that could occur despite the surge tank. In order to control any transverse flows that may arise due to different pressure at the individual drainage points, in addition the drain lines installed where the pressure is lower should be designed with a greater diameter than the drain lines installed where the pressure is higher. It would also be possible to route each of the individual drain lines—apart from one drain line, via which a constant open connection is ensured so that the condensate collector and return line is always under pressure—via a motorized valve in the condensate collector and return line, instead of directly to the condensate collector line. However, this alternative would be more cost intensive.

According to a further embodiment of the present invention, the evaporator for removing the condensate present in it via additional drain lines can also preferably connect to the condensate collector and return line, whereby an outlet line provided with a valve branches off from the condensate collector and return line, and is connected to a waste water collecting tank. Correspondingly the water present in the evaporator can also be drained via the inventive condensate collector line into the waste water tank. This has the advantage that the waste water tank does not need to be installed in a correspondingly large pit (for the increase in the geodetic height), but can be placed at ground level.

BRIEF DESCRIPTION OF THE DRAWINGS

The invention is described in more detail below with reference to the drawing, in which.

The same reference numbers refer below to similar components.

DETAILED DESCRIPTION OF INVENTION

Figure 1:
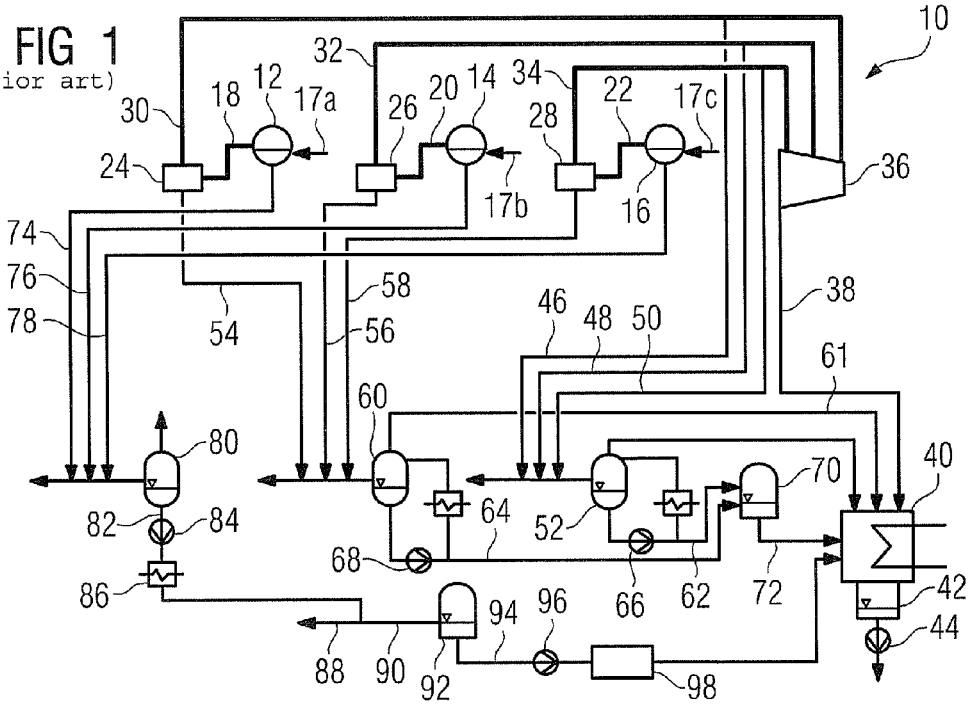
FIG 1 (prior art)
FIG. 1 shows a schematic view of a known concept of a steam circuit in a power station.

FIG. 1 is a schematic representation and shows a known concept for minimizing waste water from a steam circuit 10. The steam circuit 10 comprises three steam generators 12, 14 and 16, which vaporize water preheated in the economizers to steam, wherein, in FIG. 1 only the corresponding intakes 17*a*, 17*b* and 17*c* of the economizers into the drums of the evaporator 12, 14 and 16 are shown. The steam is routed on from the steam generators 12, 14 and 16 via lines 18, 20 and 22 to overheaters 24, 26 and 28, where it is overheated and then routed via corresponding lines 30, 32 and 34 to corresponding stages of a steam turbine 36. In the steam turbine 36 the bulk of the heat energy from the overheated steam is converted into kinetic energy. The cooled steam leaves the steam turbine 36 via a line 38 and is routed to a condenser 40, in which is further cooled and condensed. The condensate reaches the hot well 42 arranged below the condenser 40, where a pump 44 pumps it towards the steam generators 12, 14 and 16 again. Between the pump 44 and the steam generators 12, 14 and 16, the condensate can be brought to a specified temperature by means of a preheater (not shown). In this way one has a closed steam circuit.

In order when draining the steam circuit 10 to separate the "clean" waste water in the steam area of the steam circuit 10, that is to say the waste water that can be reused directly in the steam circuit 10, from the "contaminated" waste water in the water area of the steam circuit 10, which water is not suitable for direct reuse in the steam circuit 10 without being treated beforehand, the steam circuit 10 contains a special drainage system, which will be described in detail below.

In order to drain the lines 30, 32 and 34, in which there is steam at the time of a shut down of the power station, drain lines 46, 48 and 50 are provided to convey the condensate present in the lines 30, 32 and 34 into a collecting tank 52, in which the remaining residual steam is condensed. The condensate accumulated in the overheaters 24, 26 and 28 is conveyed via drain lines 54, 56 and 58 into a further collecting tank 60, in which the remaining steam is also condensed. The tanks 52 and 60 are connected to the condenser. Because of the corresponding low pressure, the incoming condensate will partly vaporize and reach the condenser 40 via the connecting line 61. The residual condensate collected in the collecting tanks 52 and 60 is pumped via lines 62 and 64 by means of pumps 66 and 68 into a condensate collecting tank 70 and stored there. If need be, the condensate stored in the condensate collecting tank 70 can then be routed again via a line 72 to the condenser 40 and in this way to the actual steam circuit. The separation of the clean waste water and feeding back into the steam circuit 10 enables the amount of waste water produced to be reduced by up to 60%, which saves on costs in the long-term. In addition, because of the reduction in the amount of waste water produced, expenditure related to the generation and later treatment of demineralized water is reduced.

The "contaminated" waste water in the water area of the steam circuit 10 shown in FIG. 1, which water is produced especially when the steam generators 12, 14 and 16 are drained, is conveyed via drain lines 74, 76 and 78 to a waste water collecting tank 80. As the tank 80 is directly connected to the condenser 40, the incoming contaminated condensate will in part vaporize and enter the condenser 40 via the connecting line 61. This is permissible, as, due to the separation into water and steam phase, the chemical quality in the steam circuit is not compromised. Using a pump 84, the contaminated residual condensate collected in the waste water collecting tank 80 can be conveyed via a line 82 to a heat exchanger 86, where it is correspondingly cooled. Subsequently, the cooled condensate can be discarded via a line 88 and conveyed to the general waste water system, wherein there can be a waste water treatment plant (not shown) connected to the line 88, which plant treats the waste water so as to render it compatible with the statutory regulations. Alternatively the condensate can be conveyed from the heat exchanger 86 via a line 90 to a collecting tank 92 and stored therein. Using a pump 96, the condensate contained in the collecting tank 92 can then be conveyed via a line 94 to a condensate treatment device 98, in which it is treated so that it meets the requirements placed on the water used in the steam circuit 10. The condensate treated in this way can then be conveyed to the condenser 40 in order to feed the condensate into the actual steam circuit 10 again.

One disadvantage of the steam circuit 10 shown in FIG. 1 is that in particular the draining of the overheaters 24, 26 and 28 is very complicated and expensive. For one thing, the drain lines 54, 56 and 58, which go from the overheaters 24, 26 and 28 to the collecting tank 60, must be relatively long in order to bridge the distance between the overheaters 24, 26 and 28 and the collecting tank 60. In addition, it requires a separate collecting tank 60, which also adds to the cost. Finally, the pump 68 must be of relatively high performance to pump the condensate held in the collecting tank 60 into the condensate collecting tank 70.

Figure 2:
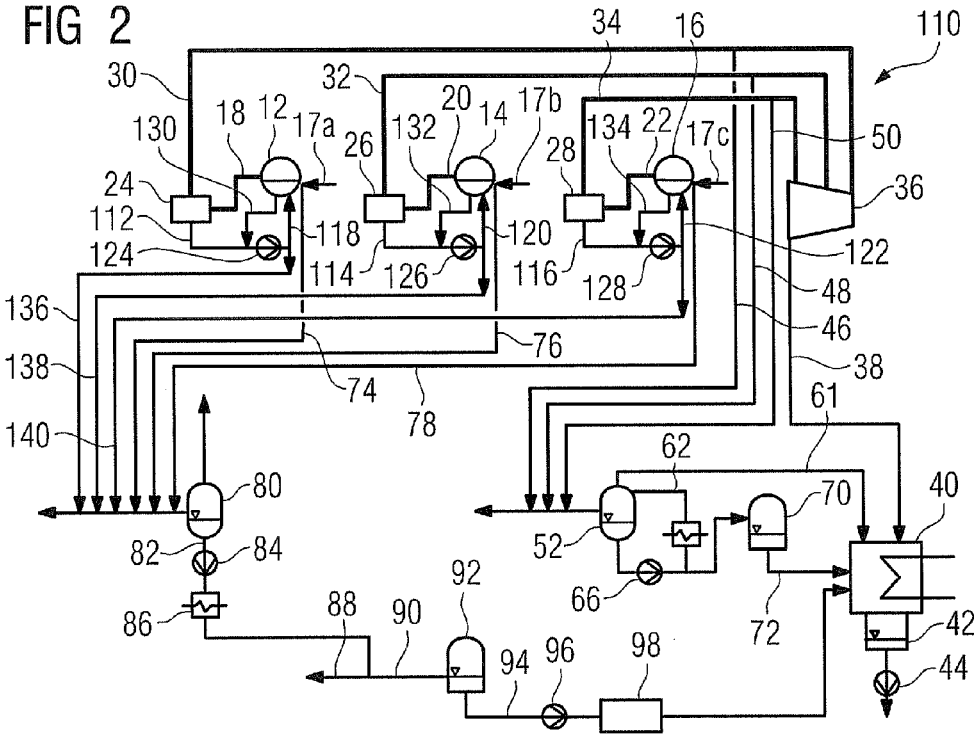
FIG. 2 shows a schematic view of an embodiment of the steam circuit according to the invention.

FIG. 2 shows a schematic view of an embodiment of the steam circuit 110 according to the invention. Components corresponding to those of the steam circuit 10 shown in FIG. 1 are marked with the same reference number. The steam circuit 110 shown in FIG. 2 corresponds essentially to the steam circuit 10 in FIG. 1. The steam circuit 110 differs, however, from the steam circuit 10 by the draining of the overheaters 24, 26 and 28 and by the conveying of the residual draining of the evaporators 12, 14 and 16, which is described in detail below.

The corresponding drain lines 112, 114 and 116 branch off from the overheaters 24, 26 and 28. Said drain lines each flow into a condensate collector and return line, which is explained in more detail with reference to FIG. 3. Using the corresponding pumps 124, 126 and 128, the condensate collected in the condensate collector lines can be pumped back directly into the associated evaporator 12, 14 and 16 via return lines 118, 120, and 122. If desired the waste water contained in the evaporators 12, 14 and 16 can be carried via drain lines 130, 132 and 134 to the condensate collector lines and conveyed via lines 136, 138 and 140 into the waste water collecting tank 80.

Figure 3:
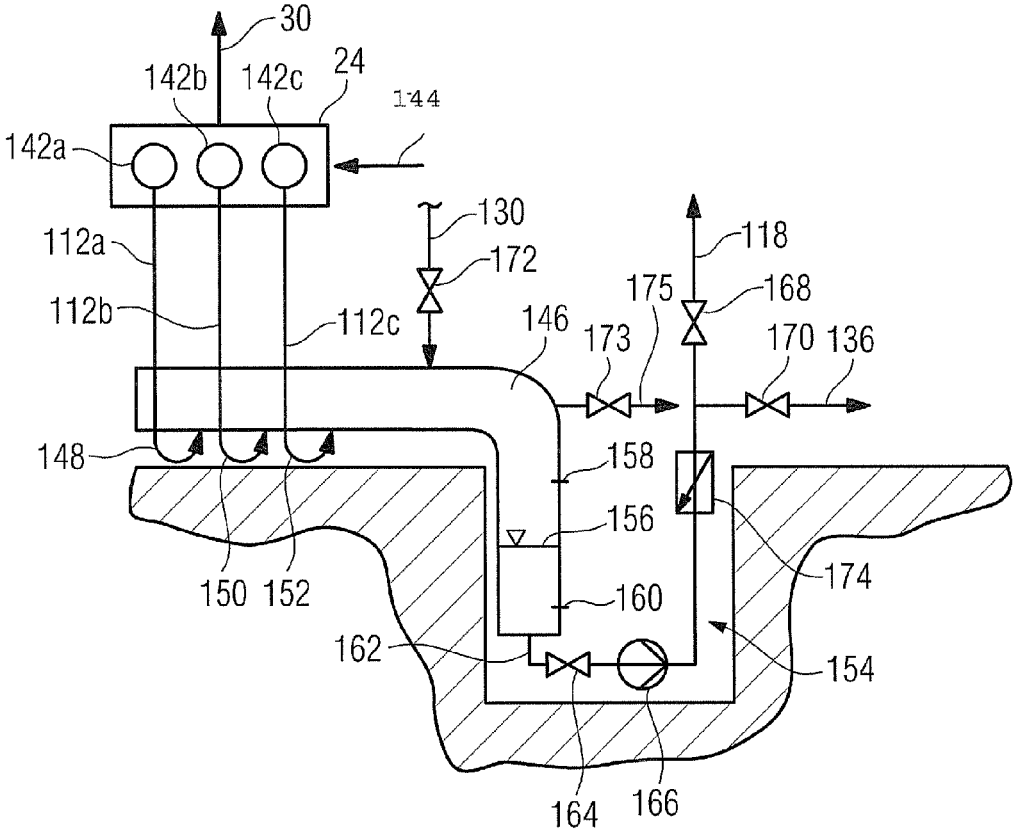
FIG. 3 shows a schematic view of an embodiment of a condensate collector line of the steam circuit according to the invention.

The more detailed design of an overheater and steam generator drainage system is shown schematically in FIG. 3, wherein FIG. 3 by way of example shows the draining system of the overheater 24 and the evaporator 12. The draining systems for the overheater 26 and the evaporator 14 as well as for the overheater 28 and the evaporator 16 correspond to the system shown in FIG. 3.

FIG. 3 shows the overheater 24, which has three manifolds 142*a*, 142*b* and 142*c*. The individual overheater pipes connect into these manifolds 142*a*, 142*b* and 142*c*. Hot waste gas from the power station flows in the direction of the arrow 144 past the three overheater pipes, so that the manifold 142*c* is heated more strongly than the manifold 142*b*, and the latter stronger than the manifold 142*a*. The drain lines 112*a*, 112*b* and 112*c* branch off from the respective manifolds 142*a*, 142*b* and 142*c*, said drain lines flows into a condensate collector and return line 146 that is just over 0 m. The individual pipe diameter of each overheater pipe that flows into a manifold 142*a*, 142*b* and 142*c*, is thereby greater than the line diameter of the corresponding drain line 112*a*, 112*b* and 112*c*. The aim is to thus ensure that overheated steam flows in the direction of manifolds 142*a*, 142*b* and 142*c* and does not get into the drain lines 112*a*, 112*b* and 112*c*. The drain lines 112*a*, 112*b* and 112*c* only serve to drain the condensate contained in the manifolds 142*a*, 142*b* and 142*c*. Surge tanks 148, 150 and 152 are provided at the connecting point between the drain lines 112*a*, 112*b* and 112*c* and the condensate collector and return line 146. Said surge tanks are also aimed at preventing the ingress of steam into the condensate collector and return line 146. The surge tanks 148, 150 and 152 are designed here as U-shaped lines, in which condensate collects, the aim of which is to prevent steam entering into the condensate collector and return line 146. The condensate collector and return line 146 is here essentially of an L-shape design, wherein a section of the condensate collector and return line 146 stretches essentially vertically downwards into a pit 154. The condensate that was taken from the manifolds 142*a*, 142*b* and 142*c* via the drain lines 112*a*, 112*b* and 112*c* gathers in this essentially vertically downwards stretching section of the condensate collector and return line 146. The level of the condensate collected in the condensate collector and return line 146 is characterized by reference number 156. The condensate collector and return line 146 also has a level detection device (not described in detail), which detects a maximum level 158 and a minimum level 160 of the condensate accumulated in the condensate collector and return line 146. A line 162, comprising a valve 164 and a pump 166 arranged at about −2 m, connects to the condensate collector and return line 146 through the line 162. When the valve 164 is open, pump 166 can be used to pump condensate from the condensate collector and return line 146 through the line 162. Behind the pump 166, the line 162 branches into the return line 118, which has a valve 168, and into the line 136, which also has a valve 170. Valve 170 configured to empty the condensate collector and return line for emergency control in the event of a failure. The operation of the condensate collector line 146 is described in more detail below.

If the condensate level 156 reaches the maximum level 158, which is detected by the level detection device (not shown), the pump 166 is switched on, whereby the valves 164 and 168 are open and the valve 170 is closed. In this way, the condensate collected in the condensate collector and return line 146 is pumped back into the evaporator 12. If the level detection device detects that the condensate level 156 has reached the minimum level 160, then the pump 166 is stopped, so that no further condensate is conveyed from the condensate collector and return line 146 via the lines 162 and 118 into the evaporator 12. This scenario is repeated as soon as the maximum level 158 is reached again. If the condensate level 156 reaches the maximum level 158 without the pump 166 starting up, then an alarm is triggered as there must be a fault in the pump 166 or the pump control system. If the pump 166 is faulty then the valve 170 of the line 156 can be opened and the condensate drained into the waste water collecting tank 80.

For the purpose of draining the evaporator 12, the evaporator 12 and the condensate collector and return line 146 are connected to each other via the drain line 130, wherein the drain line 130 has a valve 172. If the condensate contained in the evaporator 12 is emptied then the valve 168 of the return line 118 is closed and the valve 170 of the line 136 and also the valve 172 of the drain line 130 are opened. Thus using the pump 166, the pressurized condensate contained in the evaporator 112 can flow via the drain line 130, the condensate collector line 146 and the line 136 to the waste water collecting tank 80.

The valves 164, 170 and 168 can be closed for ease of maintenance or trouble free repair on work pump 166.

The draining system shown in FIG. 3 is designed to be movable so as to counteract any build up of stress due to the cyclical heating and cooling.

An essential advantage of the above described draining systems for the overheaters 24, 26 and 28 and the evaporators 12, 14 and 16 lies in the simplicity of its design. Furthermore, in comparison with the steam circuit 10 shown in FIG. 1, it is possible to dispense with the (motorized) flow control devices, the collecting tank 60, the pump 68 and the line 64, which allows for considerable cost savings. In addition, the waste water tank 80 does not need to be positioned deep down so the costs for the pit are reduced. It is also to be mentioned that pump 166 must have a substantially lower performance compared with pump 68.

It should be clear that the present invention is not restricted to the above described exemplary embodiment. Rather, modifications and changes are possible without going beyond the scope of protection as defined by the attached claims.

The invention claimed is:

1. A steam circuit in a power station comprising:
an evaporator;
an overheater; and
a condensate collector and return line arranged between the overheater and the evaporator in order to trap condensate present in the overheater and to return the condensate to the evaporator.

2. The steam circuit as claimed in claim 1, wherein the volume of the evaporator is greater than the volume of the overheater.

3. The steam circuit as claimed in claim 1, wherein the condensate collector and return line has a pump.

4. The steam circuit as claimed in claim 3, wherein the operation of the pump is controlled as a function of the amount of condensate present in the condensate collector and return line.

5. The steam circuit as claimed in claim 3, further comprising an upstream flow control device arranged upstream of the pump and a downstream flow control device arranged downstream of the pump.

6. The steam circuit as claimed in claim 3, further comprising an upstream flow control device arranged upstream of the pump and a downstream flow control device arranged downstream of the pump.

7. The steam circuit as claimed in claim 1, wherein the condensate collector and return line has at least one flow control device.

8. The steam circuit as claimed in claim 1, further comprising a drain line branching off from the overheater, wherein the condensate present in the overheater is led to the condensate collector and return line by the drain line.

9. The steam circuit as claimed in claim 1, wherein the diameter of a manifold from which the drain line branches off is greater than the diameter of the drain line such that overheated steam flows in the direction of the manifold.

10. A steam circuit in a power station comprising:
an evaporator;
an overheater; and
a condensate collector and return line arranged between the overheater and the evaporator in order to trap condensate present in the overheater and to return the condensate to the evaporator,
wherein a line provided with an emergency valve and connected to a waste water tank branches off from the condensate collector and return line.

11. The steam circuit as claimed in claim 10, wherein the volume of the evaporator is greater than the volume of the overheater.

12. The steam circuit as claimed in claim 10, wherein the condensate collector and return line has at least one flow control device.

13. The steam circuit as claimed in claim 10, wherein a drain line is arranged between the overheater and the condensate collector and return line in order to receive the condensate from the overheater and provide the condensate to the condensate collector.

14. The steam circuit as claimed in claim 10, wherein the diameter of a manifold from which the drain line branches off is greater than the diameter of the drain line such that overheated steam flows in the direction of the manifold.

15. A steam circuit in a power station comprising:
an evaporator;
an overheater; and
a condensate collector and return line arranged between the overheater and the evaporator in order to trap condensate present in the overheater and to return the condensate to the evaporator,
wherein the evaporator for removing the condensate present in the steam circuit is connected to the condensate collector and return line via additional drain lines and a line with a valve branches off from the condensate collector and return line and is connected to a waste water tank.

16. The steam circuit as claimed in claim 15, wherein the volume of the evaporator is greater than the volume of the overheater.

17. The steam circuit as claimed in claim 15, wherein the condensate collector and return line has at least one flow control device.

18. The steam circuit as claimed in claim 15, further comprising an upstream flow control device arranged upstream of the pump and a downstream flow control device arranged downstream of the pump.

19. The steam circuit as claimed in claim 15, wherein a drain line is arranged between the overheater and the condensate collector and return line in order to receive the condensate from the overheater and provide the condensate to the condensate collector.

20. A steam circuit in a power station comprising:

an evaporator;

an overheater; and a condensate collector and return line arranged between the overheater and the evaporator in order to trap condensate present in the overheater and to return the condensate to the evaporator, wherein the condensate collector and return line has a pump, and wherein a line provided with an emergency valve and connected to a waste water tank branches off from the condensate collector and return line.

* * * * *